US006967649B2

(12) United States Patent
Sun

(10) Patent No.: US 6,967,649 B2
(45) Date of Patent: Nov. 22, 2005

(54) METHOD FOR REDUCING POWER CONSUMPTION OF AN LCD PANEL IN A STANDBY MODE

(75) Inventor: Wein-Town Sun, Kao-Hsiung (TW)

(73) Assignee: AU Optronics Corp., Hsin-Chu (TW)

( * ) Notice: Subject to any disclaimer, the term of this patent is extended or adjusted under 35 U.S.C. 154(b) by 347 days.

(21) Appl. No.: 10/460,353

(22) Filed: Jun. 13, 2003

(65) Prior Publication Data

US 2004/0130543 A1 Jul. 8, 2004

(30) Foreign Application Priority Data

Jan. 3, 2003 (TW) ..... 92100145 A

(51) Int. Cl.[7] ..... G09G 5/00

(52) U.S. Cl. ..... 345/211; 345/96

(58) Field of Search ..... 345/87–88, 90–92, 345/96, 99, 100, 211, 214

(56) References Cited

U.S. PATENT DOCUMENTS

| | | | | |
|---|---|---|---|---|
| 6,618,030 | B2 * | 9/2003 | Kane et al. | 345/82 |
| 2001/0024186 | A1 * | 9/2001 | Kane et al. | 345/98 |
| 2002/0149557 | A1 * | 10/2002 | Goetz et al. | 345/100 |
| 2004/0055963 | A1 * | 3/2004 | Toyozawa et al. | 210/744 |

* cited by examiner

*Primary Examiner*—Ricardo Orsorio
*Assistant Examiner*—Mansour M. Said
(74) *Attorney, Agent, or Firm*—Winston Hsu

(57) ABSTRACT

A method for reducing power consumption of an LCD panel in a standby mode. The LCD panel includes a plurality of pixel drivers each having a liquid crystal capacitor, a storage capacitor, four switches, a comparator, and a selection circuit. The method includes turning off the first switch and the third switch and turning on the second and the fourth switch so as to use the comparator to compare the voltage of the storage capacitor with a reference voltage; and generating a control signal to the selection circuit according to an output of the comparator so that the selection circuit can output a corresponding display signal to the liquid crystal capacitor according to the control signal.

10 Claims, 7 Drawing Sheets

METHOD FOR REDUCING POWER CONSUMPTION OF AN LCD PANEL IN A STANDBY MODE

BACKGROUND OF INVENTION

1. Field of the Invention

The present invention relates to a liquid crystal display (LCD) panel, and more specifically, to a method of operation of a standby mode of an LCD panel.

2. Description of the Prior Art

A LCD panel operating in the normal mode displays an image with high color, high contrast, and high refresh rate, but has higher power consumption.

Generally, the equation used in calculating the consumed power is: $CV^2F+I_SV$; where C is capacitance; V is voltage; F is frequency, and $I_S$ is static current. The values of the capacitance and the voltage usually determine the size and resolution of the LCD panel, and the frequency determines the resolution and performance of a first switch. For reducing power consumption, the LCD panel displays a static image in low gray level via a circuit so that a lower voltage and frequency are transmitted in the data line.

Please refer to FIG. 1 and FIG. 2. FIG. 1 is a schematic diagram of an LCD panel pixel driver 10 combined with a digital memory 22 according to the prior art. FIG. 2 is a diagram of signals of the pixel driver 10. In FIG. 1, the pixel driver 10 comprises a first switch 12, a storage capacitor 14, and a liquid crystal capacitor 16. The signal of a scan line 20 turns on the first switch 12 so that the signal in the data line 18 is transmitted to the liquid crystal capacitor 16. The storage capacitor 14 and the liquid crystal capacitor 16 are connected in parallel for maintaining the voltage of the liquid crystal capacitor 16. Additionally, the pixel driver 10 comprises a digital memory 22. A first end of the pixel driver 10 is connected to a first end of liquid crystal capacitor 16, and a second end of the pixel driver 10 is connected to the first end of the liquid crystal capacitor 16 through a third switch 24. A second end of the liquid crystal capacitor 16 is connected to a common voltage $V_{COM}$ that is an oscillating voltage. The second switch 24 and the third switch 26 are controlled by a first control line 28 and a second control line 30 respectively.

When the LCD panel operates in a normal mode, the first control line 28 turns off the second switch 24, and the second control line 30 turns off the third switch 26. The data in the data line 18 is transmitted to the liquid crystal capacitor 16 through the first switch 12.

When the LCD panel operates in a standby mode, the data of the liquid crystal capacitor 16 is possibly a high voltage or a low voltage. FIG. 2 is a schematic diagram showing the data in the liquid crystal capacitor 16 as a high voltage when the LCD panel operates in a standby mode. In FIG. 2, when the LCD panel operates in a pre-standby mode, the signal of the first control line 28 turns on the second switch 24 to transmit the high voltage stored in the liquid crystal capacitor 16 to the digital memory 22. Then, when the LCD panel operates in standby mode, according to the oscillating cycle of the common voltage $V_{COM}$, the second switch 24 and the third switch 26 are turned on and off in turn to maintain a constant voltage difference in the liquid crystal capacitor 16 so that the LCD panel displays a black image. When the voltage stored in the digital memory 22 in the pre-standby mode is a low voltage, according to the oscillating cycle of the common voltage $V_{COM}$, with the second switch 24 and the third switch 26 being turned on and off in turn, the voltage difference in the liquid crystal capacitor 16 is zero so that the LCD panel displays a white image. In addition, storing the voltage of the liquid crystal capacitor 16 in the digital memory 22 can temporarily stop output of the high-frequency voltage in the data line 18 for reducing power consumption.

Please refer to FIG. 3. FIG. 3 is a schematic diagram of an LCD panel pixel driver 32 incorporating a dynamic memory 32 according to the prior art. In FIG. 3, the same elements of FIG. 1 use the same symbols. In addition to the first switch 12, the storage capacitor 14, and the liquid crystal capacitor 16, the pixel driver 32 further comprises a selection switch 34, a complementary selection switch 36, a first connection switch 38, a second connection switch 40, and an address switch 42. When the LCD panel operates in the normal mode, the signal of the scan line 20 turns on the first switch 12 and the address switch 42, and an updating signal line 44, and turns off the first connection switch 38 and the second switch 40, and further, inputs the signal in the data line 18 to the storage capacitor 14. When the voltage stored in the storage capacitor 14 is a high voltage, the selection switch 34 is turned on to transmit the signal of a reference voltage line 46 to the liquid crystal capacitor 16. When the voltage stored in the storage capacitor 14 is a low voltage, the selection switch 34 is turned off and the voltage of the liquid crystal capacitor 16 is held. The voltage of the liquid crystal capacitor 16 is controlled by the time that the first switch 12 and the address switch 42 are turned on by the scan line 20.

When the LCD panel operates in the standby mode, the signal of the scan line 20 turns off the first switch 12 and the address switch 42, and the signal of the updating signal line 44 turns on the first connection switch 38 and the second connection switch 40. When the voltage stored in the storage capacitor 14 is a high voltage, the selection switch 34 is turned on and the complementary selection switch 36 is turned off, and the signal in the reference voltage line 46 is transmitted to the liquid crystal capacitor 16 through the first connection switch 38. The LCD panel displays a black image. When the voltage stored in the storage capacitor 14 is a low voltage, the selection switch 34 is turned off and the complementary selection switch 36 is turned on, and the common voltage $V_{COM}$ is transmitted to the liquid crystal capacitor 16 through the second connection switch 40. The LCD panel displays a white image. Therefore, the storage capacitor 14 is identical to the dynamic memory element recording the voltage of the liquid crystal capacitor 16 when the LCD panel operates in a standby mode, and the high-frequency voltage in the data line is not transmitted for reducing power consumption.

When the LCD panel operates in a normal mode, higher voltage and frequency are transmitted in the data line 18 resulting in higher power consumption. Therefore after the LCD panel operates in a standby mode, the transient voltage is recorded by the memory in the pixel driver 32 so that the LCD panel displays a white or black display. However, when the pixel driver 10 in FIG. 1 is combined with the digital memory 22, the amount of transistors and signal lines assembled in the pixel driver 10 is quite large so that the pixel driver 32 is only suitable for a reflective or half-reflective LCD panel. Additionally, the common voltage of the pixel driver 32 in FIG. 3 is a non-oscillating signal that is not suitable for the purposes of reducing physical dimensions and power consumption.

SUMMARY OF INVENTION

It is therefore a primary objective of the claimed invention to provide a method for reducing power consumption of an LCD panel in a standby mode.

According to the claimed invention an LCD panel comprises a plurality of pixel drivers each comprising a liquid crystal capacitor, a storage capacitor, four switches, a comparator, and a selection circuit. The method for reducing power consumption comprises the following steps: (a) turning on a first switch and a third switch, and turning off a second switch and a fourth switch to transmit data from a data line to the liquid crystal capacitor and the storage capacitor; and (b) turning off the first switch and the third switch, and turning on the second switch and the forth switch to transmit the data from the data line to the comparator, the comparator comparing a voltage with a reference voltage and outputting a control signal to the selection circuit, and the selection circuit outputting a corresponding display signal to the liquid crystal capacitor according to the control signal.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
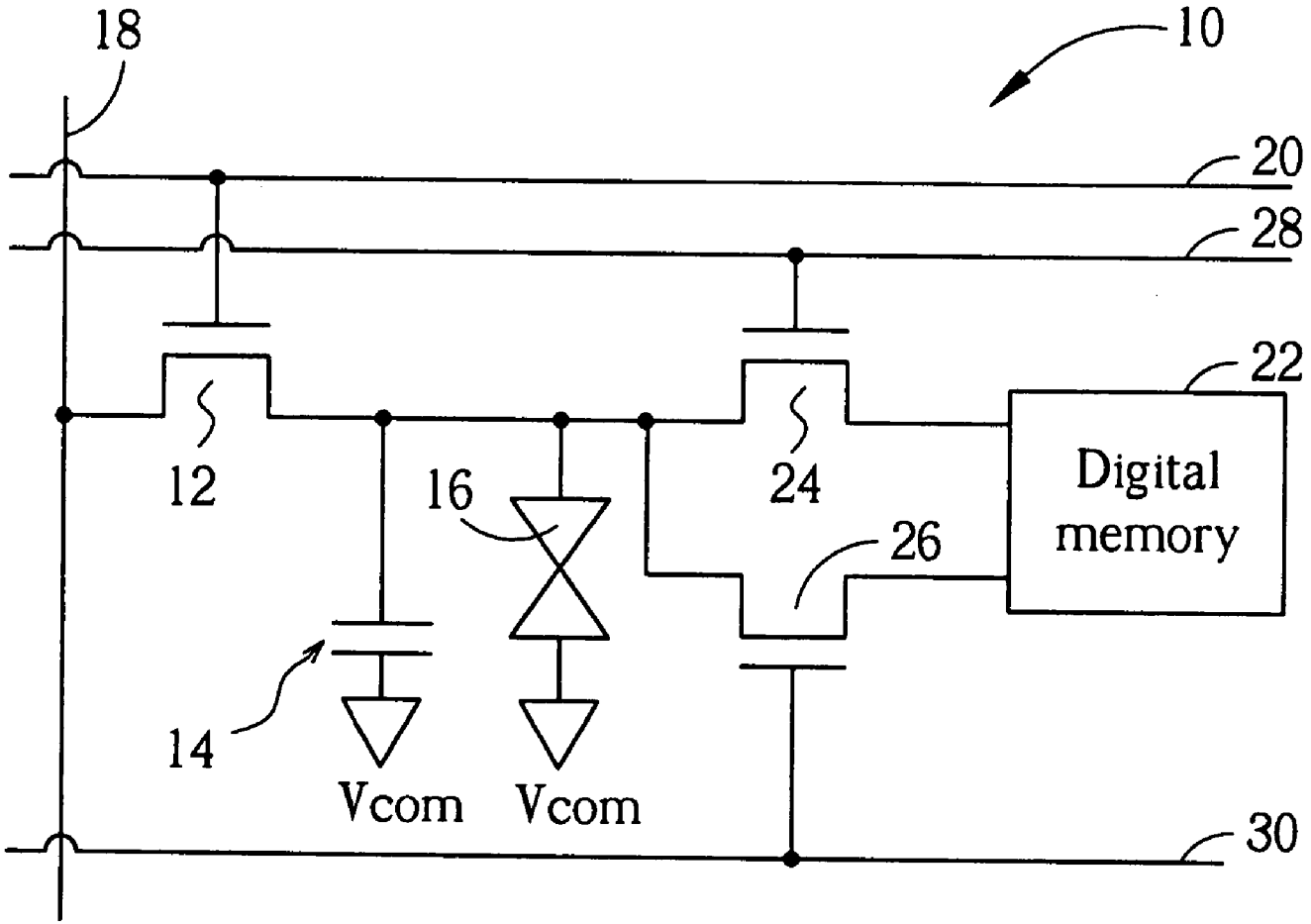
Fig. 1 Prior art
FIG. 1 is a schematic diagram of an LCD panel pixel driver combined with a digital memory according to the prior art.
Figure 2:
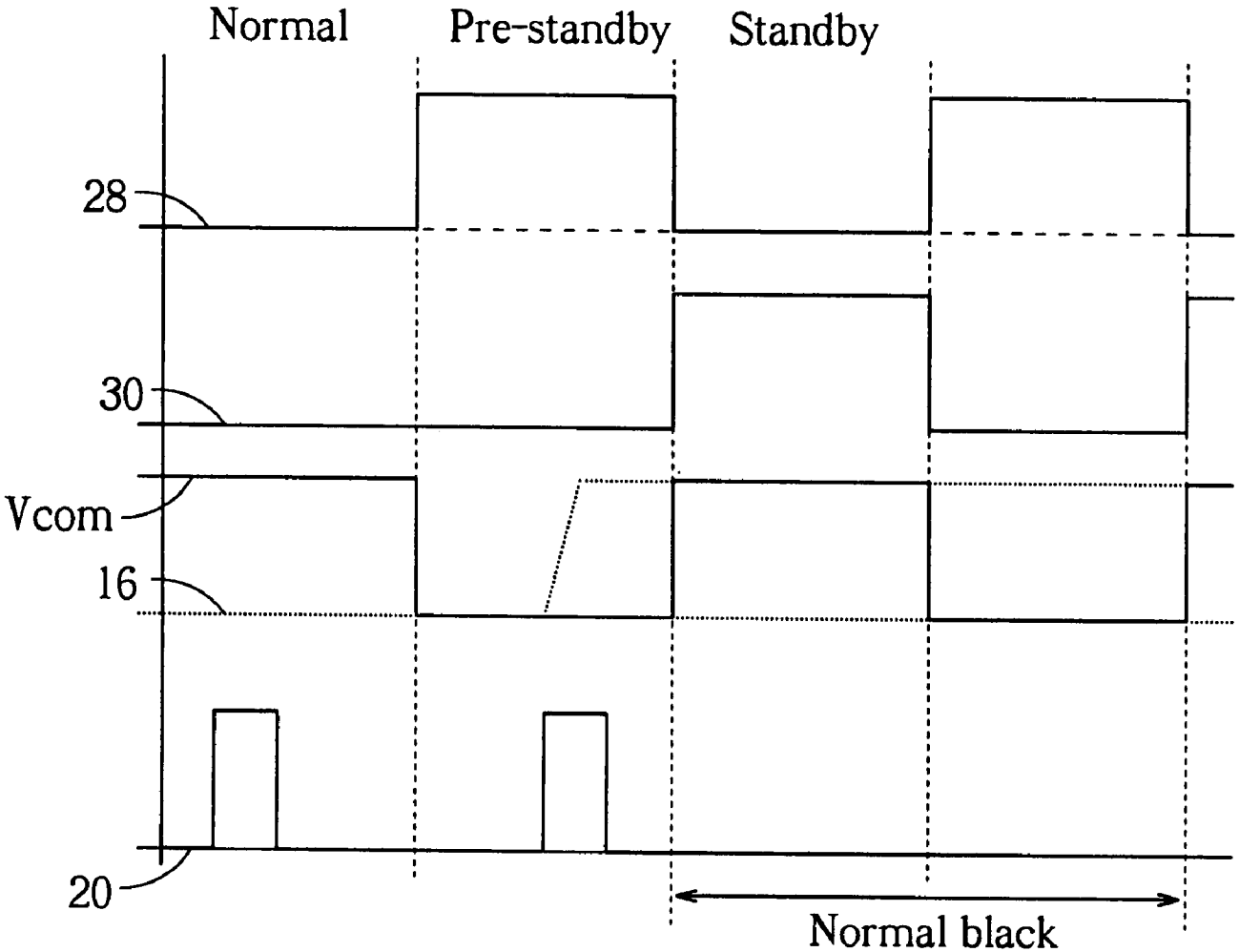
Fig. 2 Prior art
FIG. 2 is a diagram of signals of the pixel driver of FIG. 1.
Figure 3:
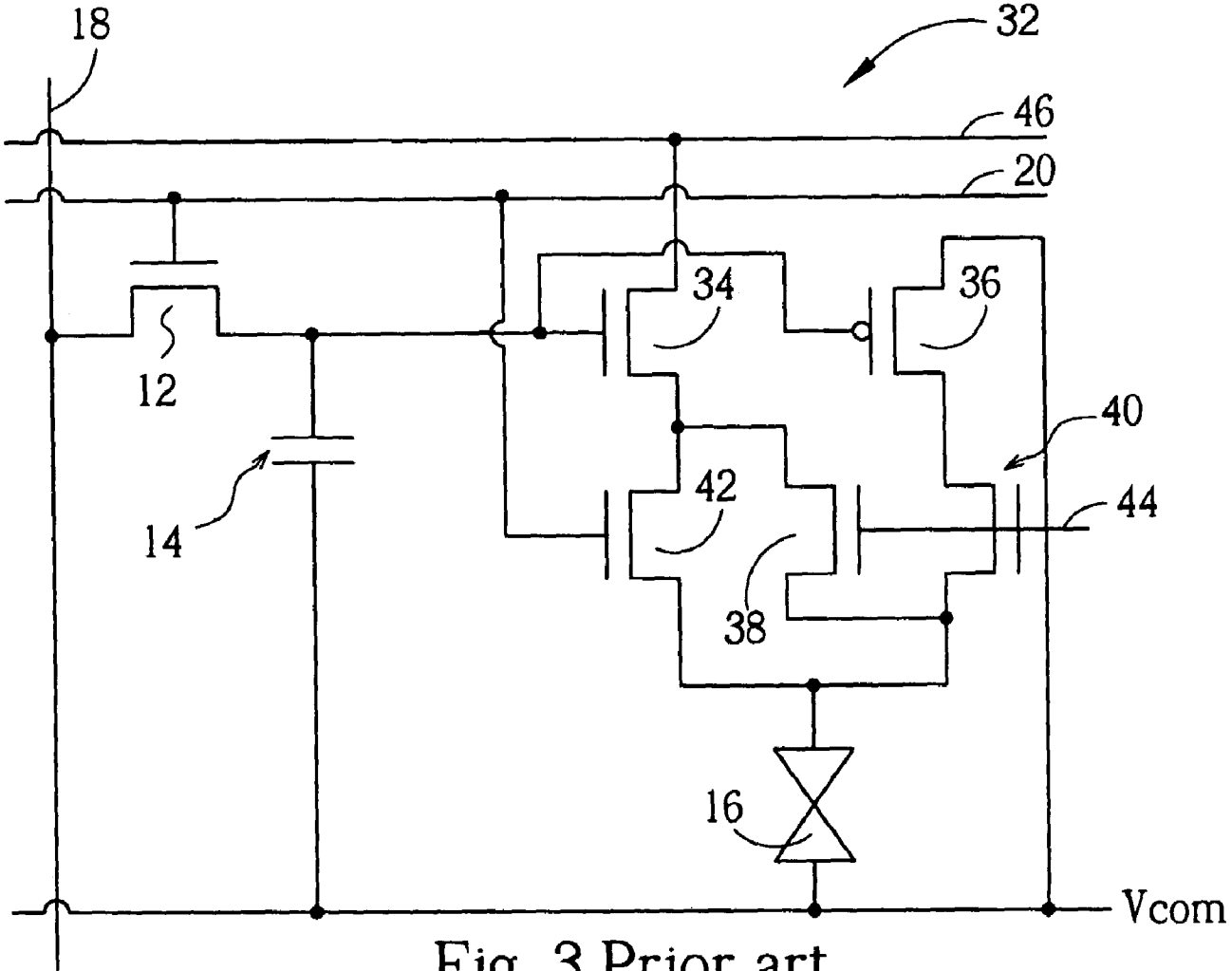
Fig. 3 Prior art
FIG. 3 is a schematic diagram of an LCD panel pixel driver combined with a dynamic memory according to the prior art.
Figure 4:
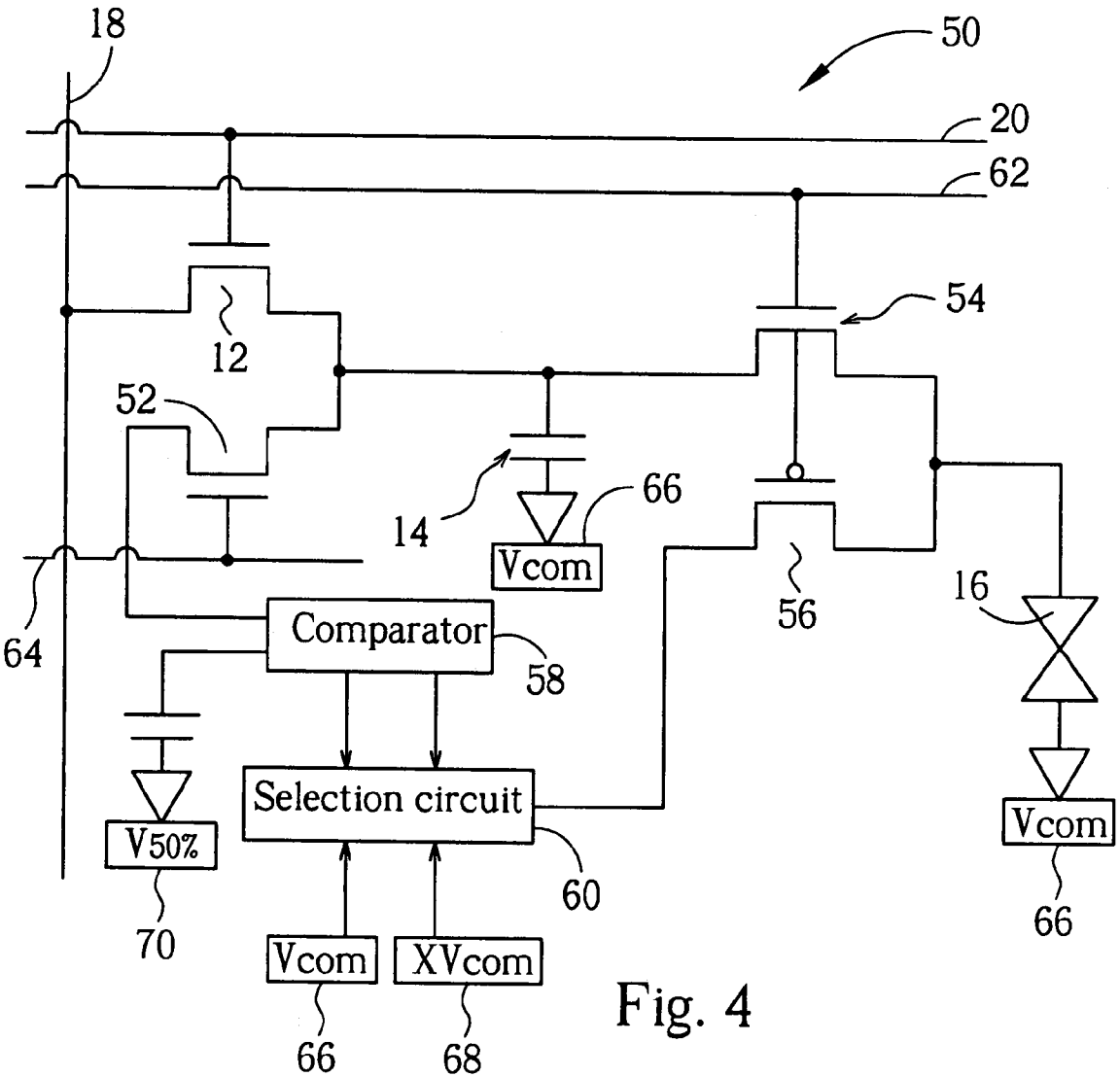
FIG. 4 is a schematic diagram of an LCD panel pixel driver according to the present invention.

Please refer to FIG. 4. FIG. 4 is a schematic diagram of an LCD panel pixel driver 50 according to the present invention. The pixel driver 50 comprises a liquid crystal capacitor 16 connected to a storage capacitor 14 through a third switch 54, a first switch 12 connected between the storage capacitor 14 and a data line 18, an input end of a comparator 58 connected to the storage capacitor 14 through a second switch 52, and an output end of a selection circuit 60 connected to a liquid crystal capacitor 16 through a forth switch 56. In addition, the pixel driver 50 comprises a scan line 20 used to control the first switch 12, a first clock 62 used to control the third switch 54 and the forth switch 56, and a second clock 64 used to control the second switch 52. The third switch 54 and the forth switch 56 are complementary. When the third switch 54 is turned on, the forth switch 56 is turned off, and when the third switch 54 is turned off, the forth switch 56 is turned on. Furthermore, ground ends of the storage capacitor 14 and the liquid crystal capacitor 16 are connected to a common voltage $V_{COM}$ 66. The common voltage $V_{COM}$ 66 can be a constant level signal or an oscillating signal. When an oscillating voltage is used, it is possible to maintain a constant voltage difference to use the lowest peak value voltage for reducing power consumption. (The common voltage $V_{COM}$ in this embodiment is an oscillating voltage.)

When the LCD panel operates in a normal mode, the first switch 12 and the third switch 54 of the pixel driver 50 are turned on, the second switch 52 and the forth switch 56 of the pixel driver 50 are turned off, and data is transmitted from the data line 18 to the liquid crystal capacitor 16 and the storage capacitor 14. When the LCD panel operates in the normal mode, the storage capacitor 14 is connected in parallel to the liquid crystal capacitor 16 to maintain the voltage of the liquid crystal capacitor 16. The voltage of the liquid crystal capacitor 16 determines the rotation angle of the liquid crystal to control the ratio of light transmission.

When the LCD operates in a standby mode, the first switch 12 and the third switch 54 of the pixel driver 50 are on, and the second switch 52 and the forth switch 56 are off, the voltage stored in the storage capacitor 14 is input to the comparator 58, the comparator 58 comparing the signal with a reference voltage $V_{50\%}$ 70. The comparator 58 outputs a control signal to the selection circuit 60 according to the comparison result, and the selection circuit 60 outputs a corresponding display signal to the liquid crystal capacitor 16 according to the control signal. The reference voltage $V_{50\%}$ 70 is a pixel voltage of approximately 50% light transmission. When the voltage stored in the storage capacitor 14 is higher than the reference voltage $V_{50\%}$ 70 when Vcom is required at the low voltage, the selection circuit 60 outputs an inverted common voltage $XV_{COM}$ 68 according to the control signal so that the voltage between the two ends of liquid crystal is a high voltage, and the LCD panel is controlled to display a black image. The inverted common voltage $XV_{COM}$ 68 is the complementary voltage signal of the common voltage $V_{COM}$ 66. When the voltage stored in the storage capacitor 14 is lower than the common voltage $V_{50\%}$ 70 when Vcom is required at the low voltage, the selection circuit 60 outputs the common voltage $V_{COM}$ 66 according to the control signal so that the voltage between the two ends of the liquid capacitor 16 is a low voltage, and the LCD panel is controlled to display a white image. The following is the detailed description of operation of the LCD panel pixel driver 50 according to the present invention.

Figure 5:
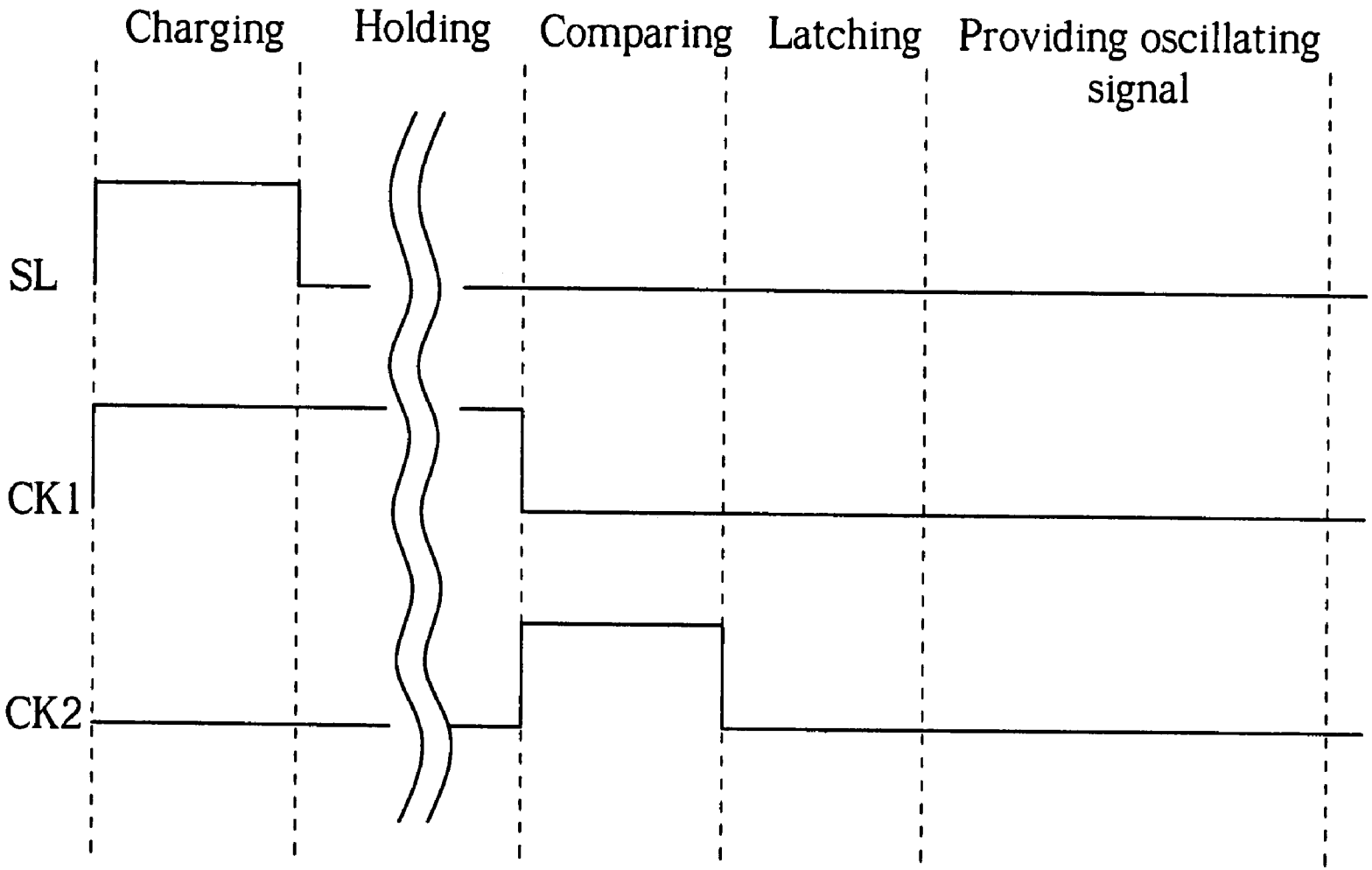
FIG. 5 is a diagram of signals of the pixel driver of FIG. 4.

Please refer to FIG. 5. FIG. 5 is a diagram illustrating signals of the pixel driver 50 during operation. As FIG. 5 shows, SL is a signal of the scan line 20, CK1 is a signal of the first clock 62, and CK2 is a signal of the second clock 64. There are two stages when the pixel driver 50 operates in the normal mode, a charging stage and a holding stage. In the charging stage, the scan line 20 turns on the first switch 12, the first clock 62 turns on the third switch 54 and turns off the forth switch 56, and the second clock 64 turns off the second switch 52 and transmits data from the data line 18 to the storage capacitor 14 and the liquid crystal capacitor 16. Then, when entering the holding stage, the scan line 20 turns off the first switch 12, the first clock 62 turns on the third switch 54 and turns off the forth switch 56 for a period, the second clock 64 turns off the second switch 52 for a period, and the storage capacitor 14 assists the liquid crystal capacitor in maintaining a constant level voltage.

There are three stages when the pixel driver 50 operates in the standby mode. The three stages are a comparing stage, a latching stage, and an oscillating stage. In the comparing stage, the scan line 20 turns off the first switch 12, the first clock 62 turns off the third switch 54 and turns on the forth switch 56, the second clock turns on the second switch 52, and the voltage stored in the storage capacitor 14 is transmitted to the comparator 58 through the second switch 52. The comparator 58 compares the voltage stored in the storage capacitor 14 and the reference voltage $V_{50\%}$ and outputs a control signal to the selection circuit 60 according to the result of the comparison. In the latching stage, the scan line 20 maintains the first switch 12 off, the first clock 62 maintains the third switch 54 on and turns on the forth switch 56, and the second clock 64 turns off the second switch 52 to confirm the output signal of the comparator 58. Finally in the oscillating stage, the states of all switches are maintained. When the voltage stored in the storage capacitor 14 is higher than the reference voltage $V_{50\%}$ 70, the control signal is a high voltage, and the selection circuit 60 outputs the common voltage $V_{COM}$ 66 to the liquid crystal capacitor 16. When the voltage stored in the storage capacitor 14 is lower than the reference voltage $V_{50\%}$ 70, the control signal is a low voltage, and the selection circuit 60 outputs the inverted common voltage $XV_{COM}$ 68 to the liquid crystal capacitor 16.

Figure 6:
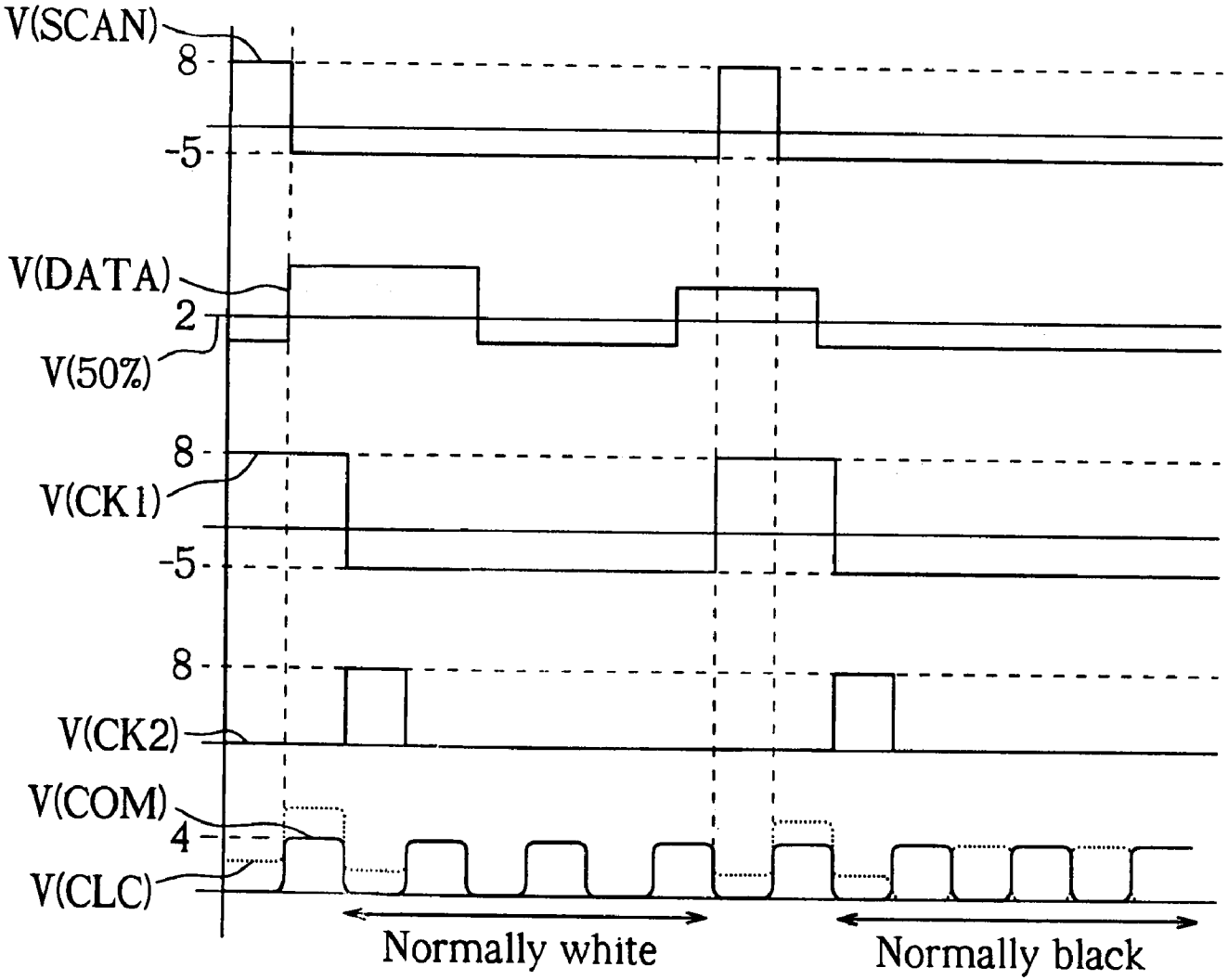
FIG. 6 is a diagram of voltages of the pixel driver of FIG. 4.

Please refer to FIG. 6. FIG. 6 is a diagram of the voltages of the pixel driver 50 during operation. A voltage V(SCAN) is the voltage of the scan line 20, V(DATA) is the voltage of the data line 18, V(50%) is the voltage of the reference voltage $V_{50\%}$, V(CK1) is the voltage of the first clock 62, V(CK2) is the voltage of the second clock 64, V(COM) is the common voltage $V_{COM}$ 66, and V(CLC) is the voltage of the liquid crystal capacitor 16. First, when the LCD panel operates in the normal mode, a high voltage of the scan line 20 turns on the first switch 12. When the voltage of the data line 18 is lower than the reference voltage $V_{50\%}$ 70, a low voltage of the second clock 64 turns off the second switch 52, and the data line 18 charges the storage capacitor 14 and the liquid crystal capacitor 16. The voltage of the scan line 20 reduced to a low voltage turns off the first switch 12, and the storage capacitor 14 sustains the voltage of the liquid crystal capacitor 16. The voltage of the first clock 62 reduced to a low voltage turns off the third switch 54 and turns on the forth switch 56. When the LCD panel operates in a standby mode, the voltage of the second clock 64 increased to a high voltage turns on the second switch 52 for a period and then turns off the second switch 52 to transmit the voltage stored in the storage capacitor 14 to the comparator 58. The comparator compares the voltage stored in the storage capacitor 14 and the reference voltage $V_{50\%}$ 70. As the voltage stored in the storage capacitor 14 is lower than the reference voltage $V_{50\%}$ 70, the comparator 58 outputs the control signal to the selection circuit 60 and the selection circuit 60 outputs the common voltage $V_{COM}$ 66 to the liquid crystal capacitor 16. As shown in the first parts of V(CLC) and V(COM) in FIG. 6, the voltage difference between the two ends of the liquid crystal capacitor 16 is zero so that the LCD panel displays a white image. When the LCD panel operates in the normal mode again, the voltage of the scan line 20 raised to a high voltage turns on the first switch 12, the voltage of the first clock 62 raised to a high voltage turns on the third switch 54 and turns off the forth switch 56, and the voltage of the second clock 64 being a low voltage turns off the second switch 52. As the voltage of the data line 18 is higher than the reference voltage $V_{50\%}$ 70, the data line 18 charges the storage capacitor 14 and the liquid crystal capacitor 16. The voltage of the scan line reduced to a low voltage turns off the first switch 12 so that the storage capacitor 14 sustains the voltage of the liquid crystal capacitor 16. When the LCD panel operates in a standby mode, the voltage of the first clock 62 reduced to a low voltage turns off the third switch 54 and turns on the forth switch 56. The voltage of the second clock 64 raised to a high voltage turns on the second switch 52 for a period and then turns off the second switch 52 to transmit the voltage stored in the storage capacitor 14 to the comparator 58. The comparator compares the voltage stored in the storage capacitor 14 with the reference voltage $V_{50\%}$ 70. As the voltage stored in the storage capacitor 14 is higher than the reference voltage $V_{50\%}$ 70, the comparator 58 outputs the control signal to selection circuit 60, and the selection circuit 60 outputs the inverted common voltage $XV_{COM}$ 68 to the liquid crystal capacitor 16. As shown in the second parts of V(CLC) and V(COM) in FIG. 6, the voltage difference between the two ends of the liquid crystal capacitor 16 is 4V so that the LCD panel displays a black image.

Figure 7:
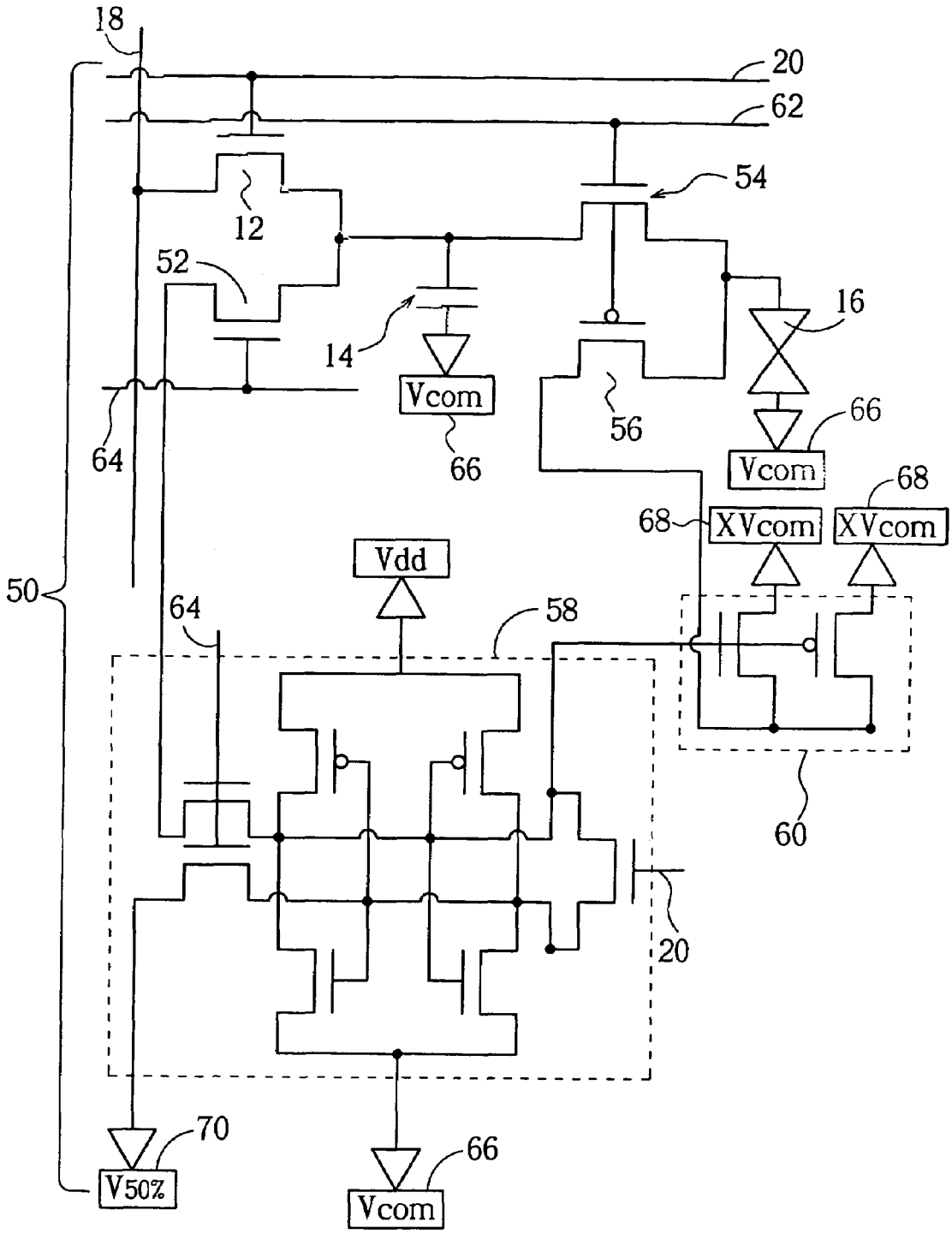
FIG. 7 is a circuit diagram of the pixel driver of FIG. 4.

Please refer to FIG. 7. FIG. 7 is a schematic diagram of circuit structure of the pixel driver 50 according to the present invention. In FIG. 7, components enclosed by a dashed line are the circuit structures of the comparator 58 and the selection circuit 60 of FIG. 4. As shown in FIG. 7, the comparator 58 comprises seven transistors and the selection circuit 60 comprises two transistors. The comparator 58 and the selection circuit 60 illustrated are examples, and other kinds of circuit structures for the comparator 58 and the selection circuit 60 are suitable for this invention. In addition, when the pixel driver is used in a 100% light transmission LCD panel, the numbers of transistors used in the comparator 58 and selection circuit 60 should be decreased.

In the present invention, a general pixel driver 50 includes the second switch 52, the third switch 54, the forth switch 56, the comparator 58, and the selection circuit 60. When the second switch 52, the third switch 54, and the forth switch 56 are turned on and off, the pixel driver 50 operates in the normal mode in much the same way as the prior art pixel driver. When the LCD panel operates in the normal mode, the comparator 50 compares the voltage of the storage capacitor 14 and the reference voltage $V_{50}$% 70 to output the control signal to the selection circuit 60 according to the comparison result. The selection circuit 60 outputs the corresponding voltage to the liquid crystal capacitor 16 according to the control signal and controls the voltage between the two ends of the liquid crystal capacitor 16 to be a high voltage or a low voltage. The LCD panel displays a normally white or a normally black image according to the voltage between the two ends of the liquid crystal capacitor 16 so that the high-frequency voltage signal in the data line 18 can be temporarily not transmitted, and the data driver and scan driver can be turned off for reducing power consumption.

Compared to the prior art, when the pixel driver 50 of the present invention operates in the normal mode, the data line 18 directly charges the storage capacitor 14 and the liquid crystal capacitor 16. The function of the pixel driver is identical to the function of the conventional pixel driver. In the prior art, the dynamic memory is combined with the pixel driver 32 and the voltage of the storage capacitor 14 controls the charge time of the liquid crystal capacitor 16, that is, not directly via the data line 18 to charge the liquid crystal capacitor 16, so that there are perhaps some problems in the operation process of the prior art. Additionally, the pixel driver 50 of the present invention is suitable for use when the reference voltage $V_{COM}$ 66 is inverted or not inverted, and the peak voltage is smaller and the power consumption is reduced when the inverted reference voltage is used. In the prior art, the common voltage $V_{COM}$ 66 of the pixel driver combined with the dynamic memory is not inverted and is consequently not suitable for reduction in size and reducing power consumption. Additionally, when the pixel driver 50 operates in the standby mode, the comparator 58 and the selection circuit 60 achieve the goal of reducing power consumption by turning off the data driver and the scan driver of the LCD panel.

Those skilled in the art will readily observe that numerous modifications and alterations of the device may be made while retaining the teachings of the invention. Accordingly, the above disclosure should be constructed as limited only by the metes and bounds of the appended claims.

What is claimed is:

1. A method for reducing power consumption of an LCD panel in a standby mode, the LCD panel comprising a plurality of pixel drivers, each pixel driver comprising:

a liquid crystal capacitor;

a storage capacitor connected to the liquid crystal capacitor through a third switch;

a first switch connected between the storage capacitor and a data line, the storage capacitor receiving data from the data line when the first switch is turned on;

a comparator connected to the storage capacitor through a second switch for receiving the data from the storage capacitor when the second switch is turned on; and a selection circuit having an input end connected to the output end of the comparator, the output end of the selection circuit connected to the liquid crystal capacitor through a fourth switch;

the method comprising the following steps:

(a) turning on the first switch and the third switch, and turning off the second switch and the fourth switch to transmit the data from the data line to the liquid crystal capacitor and the storage capacitor; and (b) turning off the first switch and the third switch, and turning on the second switch and the fourth switch to input a voltage stored in the storage capacitor to the comparator, the comparator comparing the voltage with a reference voltage and outputting a control signal to the selection circuit, the selection circuit outputting a corresponding display signal to the liquid crystal capacitor according to the control signal.

2. The method of claim 1 wherein in the step (b), when the voltage of the storage capacitor is higher than the reference voltage, the selection circuit outputs a black display signal to the liquid crystal capacitor; and when the voltage of the storage capacitor is lower than the reference voltage, the selection circuit outputs a white display signal to the liquid crystal capacitor.

3. The method of claim 1 wherein the reference voltage is a pixel voltage of approximately 50% light transmission.

4. The method of claim 1 wherein the third switch and the fourth switch are complementary; when the third switch turns on, the fourth switch turns off, and when the third switch turns off, the fourth switch turns on.

5. The method of claim 4 wherein the third switch and the first switch turn on at the same time, and the third turns off after the first switch turns off so that the storage capacitor is capable of maintaining the voltage of the liquid crystal capacitor.

6. The method of claim 5 wherein after the third switch turns off, the second switch immediately turns on for a period and then turns off so that the comparator is capable of reading the voltage of the storage capacitor.

7. The method of claim 1 wherein the LCD is in a normal mode when the third switch is on, and the standby mode when the third switch is off.

8. The method of claim 1 wherein the storage capacitor and the liquid crystal capacitor are connected to a common voltage.

9. The method of claim 8 wherein the common voltage is an oscillating signal or a constant level signal.

10. The method of claim 1 wherein the first switch is controlled by a scan line, the second switch is controlled by a second clock, and the third and fourth switches are controlled by a first clock.

* * * * *